United States Patent [19]

Chevallier

[11] 4,379,297

[45] Apr. 5, 1983

[54] ORIENTABLE ANTENNA SUPPORT

[75] Inventor: René Chevallier, Paris, France

[73] Assignee: Thomson-CSF, Paris, France

[21] Appl. No.: 222,875

[22] Filed: Jan. 6, 1981

[30] Foreign Application Priority Data

Jan. 11, 1980 [FR] France ..... 80 00611

[51] Int. Cl.[3] ..... H01Q 1/12; H01Q 1/22

[52] U.S. Cl. ..... 343/882

[58] Field of Search ..... 343/763, 880, 882, 915

[56] References Cited

U.S. PATENT DOCUMENTS

| | | | |
|---|---|---|---|
| 2,556,026 | 1/1951 | Carlisle | 343/765 |
| 3,158,866 | 11/1964 | Powers | 343/882 |
| 3,646,564 | 2/1972 | Drislane | 343/766 |
| 4,235,405 | 11/1980 | Carey | 343/882 |
| 4,251,819 | 2/1981 | Vickland | 343/882 |

FOREIGN PATENT DOCUMENTS

| | | | |
|---|---|---|---|
| 2809158 | 9/1979 | Fed. Rep. of Germany . | |
| 2044624 | 2/1971 | France . | |
| 54-37661 | 3/1979 | Japan | 343/882 |
| 979572 | 1/1965 | United Kingdom . | |

*Primary Examiner*—Eli Lieberman

*Attorney, Agent, or Firm*—Cushman, Darby & Cushman

[57] ABSTRACT

An antenna, orientable in site and azimuth, is mechanically coupled to a carrying member containing the equipment required for operating the antenna. The antenna is coupled to the carrying member by a tubular assembly forming a right-angled triangle and incorporating: a rod substantially coinciding with a vertical edge of the carrying member and which serves as the vertical rotation axis; another rod perpendicular to the first-mentioned rod at its upper end and which is fixed to the antenna by two shaft bearings in order to act as the horizontal rotation axis. A first jack makes it possible to pivot the antenna about the horizontal axis. A second jack makes it possible to pivot the antenna, the tubular assembly and the first jack about the vertical axis.

3 Claims, 1 Drawing Figure

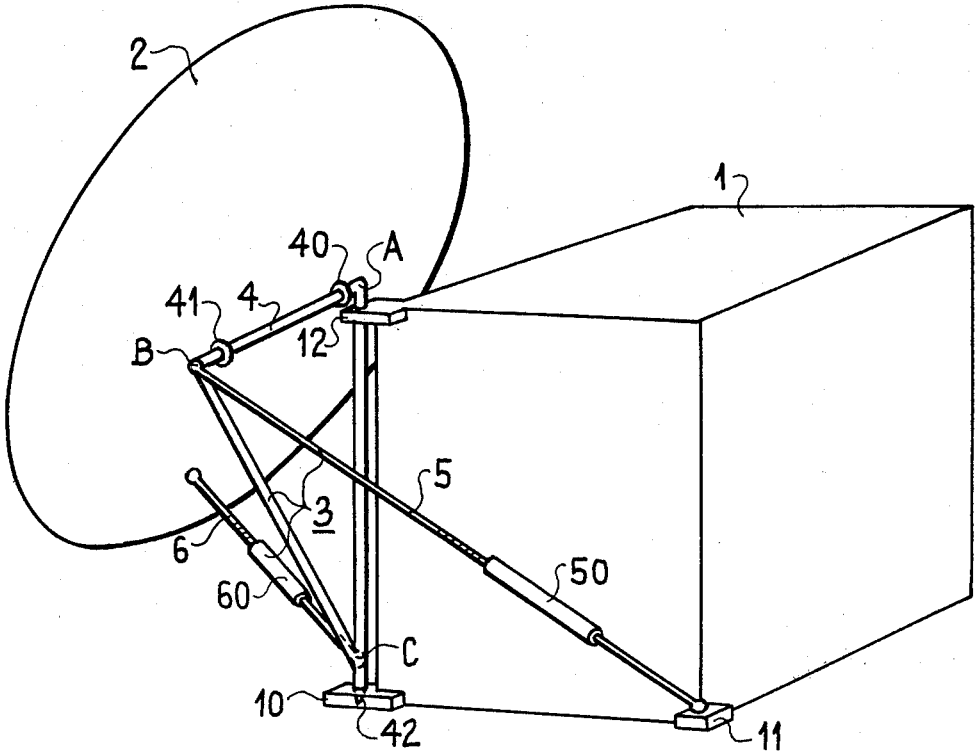
2
1
40
A
41
4
12
B
5
3
6
50
60
C
10
42
11

ORIENTABLE ANTENNA SUPPORT

BACKGROUND OF THE INVENTION

The present invention relates to an orientable antenna support constituted by a carrying member and a coupling device for coupling the antenna to the carrying member, said coupling device having a vertical rotation axis integral with the carrying member and a horizontal rotation axis integral with the antenna.

Such antenna supports make it possible to use as the carrying member the room or area housing the equipment required for the operation of the antenna. Thus, the cost of the antenna support is greatly reduced compared with antenna supports, whose carrying member is designed solely to serve as a support.

Such antenna supports are known e.g. from DOS No. 2 809 158 and more specifically the description relative to FIG. 8. In these known antenna supports the horizontal rotation axis of the antenna is spaced from the vertical rotation axis by means of a first pair of support rods of equal length joining the upper end of the vertical axis to the ends of the horizontal axis and a second pair which joins the lower end of the vertical axis to the ends of the horizontal axis. The horizontal axis and therefore the antenna are consequently spaced from the vertical axis and therefore the carrying member in order to prevent the rear part of the antenna, more particularly its supply cable, from reducing the possibilities of site control by striking against the vertical axis. In spite of its simplicity such an antenna support is expensive, more particularly due to the cost of the rods and their assembly.

BRIEF SUMMARY OF THE INVENTION

The object of the present invention is to reduce the cost of the antenna support of the type referred to hereinbefore. This is brought about by reducing the necessary number of support rods to one and possibly even eliminating them completely.

In accordance with the invention there is provided an orientable antenna support constituted by a carrying member and a coupling device for coupling an antenna to the carrying member, said coupling device having: a vertical rotation axis integral with the carrying member and having an upper end and a lower end; and a horizontal rotation axis integral with the antenna, said horizontal rotation axis having an end coinciding with the upper end of the vertical rotation axis.

DESCRIPTION OF THE DRAWING AND PREFERRED EMBODIMENTS

The invention is described in greater detail hereinafter relative to non-limitative embodiments and the attached drawing which is a diagrammatic view of an antenna support according to the invention.

The drawing shows a carrying member 1 constituted by a metal container. When placed flat on the ground this container serves to support a parabolic telecommunications antenna 2 connected thereto by a coupling device 3 constituted by a tubular assembly 4 in the form of a right-angled triangle ABC and two rods 5, 6 of regulatable length.

The container 1 serves both to house the electronic equipment associated with the antenna and as a working area for staff dealing with the antenna.

The container has a substantially square, vertical face provided at its two lower angles and one of its upper angles with fixing members 10, 11, 12 which, in the present embodiment are joined to container 1 by means of not shown bolts and nuts.

The tubular assembly 4, essentially constituted by three cylindrical rods arranged in accordance with the three sides of the triangle ABC and welded to one another, can pivot about its vertically arranged side AC. Rod AC passes through the upper member 12 which forms a collar. At its lower end in the form of a pivot this rod rests in a pivot bearing cut into member 10.

Two shaft bearings 40, 41 integral with antenna 2 and respectivey arranged in the vicinity of the ends of rod AB permit the pivoting of antenna 2 about said rod. Rod BC merely has the function of supporting the antenna.

The rods 5, 6 of regulatable length are provided at their ends with ball and socket joints, symbolized in the drawing by balls. Manually controlled screw jacks 50, 60 make it possible to regulate the length of rods 5, 6.

The length variations of rod 5 determine the azimuthal displacement of the antenna by rotation about rod AC, which thus constitutes the vertical rotation axis or azimuth rotation axis of the antenna. To this end rod 5 is fixed by means of its two ball and socket joints to member 11 on the one hand and to the angle B of tubular assembly 4.

The length variations of rod 6 determine the slight displacement of the antenna by rotation about rod AB, which thus constitutes the horizontal rotation axis or site rotation axis of the antenna. To this end rod 6 is fixed via its two ball and socket joints on the one hand to angle C of tubular assembly 4 and on the other to the rear of the antenna at a point which is far enough away from the straight line passing through the ends of rod AB to ensure that only a limited force is required for pivoting the antenna around rod AB.

It should be noted that when fixed to the tubular assembly 4 the antenna is substantially centred on the centre of AB and is therefore displaced in the plane ABC with respect to the vertical rotation axis AC. This ensures that the rear part of the antenna and particularly the not shown supply cable does not reduce the site control possibilities by striking against the vertical axis.

For information the parabolic telecommunications antenna used in exemplified manner in the present description is an antenna with a diameter of three meters working in the 11 GHz band, whilst the area used is a metal container with a height of approximately 2 m, a width of approximately 2 m and a length of approximately 3 m.

Constructions differing from that shown in the drawings can be envisaged without passing beyond the scope of the invention. Thus, rod AB can be eliminated, as can the shaft bearings 40 and 41. Bars AC and BC are then respectively articulated at A and B on antenna 2 in such a way that the site rotation axis of the antenna continues to be the AB axis. In the same way the manual screw jacks 50, 60 can be replaced by hydraulic jacks.

It is also possible to eliminate the support rod BC, provided that rods AB and AC are retained. However, the mechanical stresses at point A then cause constructional problems in attempting to avoid displacement of the antenna as a result of wind.

The invention is also applicable in general terms to orientable antennas, both when the antenna orientation only has to vary for controls and when the antenna orientation has to vary continuously for performing a scanning operation.

What is claimed is:

1. An orientable antenna support constituted by a carrying member and a coupling device for coupling an antenna to the carrying member, said coupling device including means defining a vertical rotation axis integral with the carrying member and means defining an upper end and a lower end; and a horizontal rotation axis integral with the antenna, said horizontal rotation axis having an end coinciding with the upper end of the vertical rotation axis, and the two rotation axes being respectively formed by a first and a second rod forming the two sides of the right angle of a right-angled triangle, whose hypotenuse is formed by a third rod integral with the first and second rods.

2. An orientable antenna support comprising a carrying number and a coupling device for coupling an antenna thereto, said coupling device including:

means defining a vertical rotation axis integral with said carrying member and having an upper and lower end;

means defining a horizontal rotation axis integral with the antenna, said horizontal rotation axis having an end coinciding with the upper end of the vertical rotation axis; and azimuthal control means formed by a rod of adjustable length having a first and articulated to one point of the carrying member and a second end articulated to one point of the horizontal rotation axis and in which the point of the carrying member to which is articulated the first end of the rod is located at substantially the same level as the lower end of the vertical axis.

3. An antenna support according to claim 2, wherein the two rotation axes are respectively formed by a first and second rod forming the two sides of the right angle of a right-angled triangle, whose hypotenuse is formed by a third rod integral with the first and second rods.

* * * * *